US012692682B2

(12) United States Patent
Moon

(10) Patent No.: US 12,692,682 B2
(45) Date of Patent: Jul. 28, 2026

(54) SELF-LEVELING KIT AND LOADER WORK APPARATUS WITH THE KIT

(71) Applicant: DAEDONG MOBILITY CORP., Anseong-si (KR)

(72) Inventor: Jung Hyun Moon, Anseong-si (KR)

(73) Assignee: DAEDONG MOBILITY CORP., Anseong-si (KR)

( * ) Notice: Subject to any disclaimer, the term of this patent is extended or adjusted under 35 U.S.C. 154(b) by 260 days.

(21) Appl. No.: 18/743,301

(22) Filed: Jun. 14, 2024

(65) Prior Publication Data

US 2025/0012038 A1 Jan. 9, 2025

(30) Foreign Application Priority Data

Jul. 6, 2023 (KR) ..... 10-2023-0087452

(51) Int. Cl.
*E02F 3/28* (2006.01)
*E02F 3/43* (2006.01)

(52) U.S. Cl.
CPC ..... *E02F 3/283* (2013.01); *E02F 3/433* (2013.01)

(58) Field of Classification Search
None
See application file for complete search history.

(56) References Cited

U.S. PATENT DOCUMENTS 5,405,237 A * 4/1995 Oka ..... B66F 9/065 414/722
6,205,665 B1 3/2001 Anderson et al.

* cited by examiner

*Primary Examiner* — Michael S Lowe
(74) *Attorney, Agent, or Firm* — Revolution IP, PLLC

(57) ABSTRACT

A loader work apparatus includes: a bucket connecting arm connected to a bucket for scooping or holding cargo; a bucket cylinder having a variable length to allow the bucket to rotate about a connection part of the bucket connecting arm; a boom cylinder providing force for raising and lowering the bucket connecting arm; a boom connected to the bucket connecting arm and the boom cylinder; a boom support part to which the boom and the boom cylinder are coupled; and a boom connecting plate to which the bucket connecting arm, the boom cylinder, and the boom are coupled.

5 Claims, 6 Drawing Sheets

SELF-LEVELING KIT AND LOADER WORK APPARATUS WITH THE KIT

BACKGROUND OF THE INVENTION

1. Field of the Invention

The present invention relates to a loader work apparatus, particularly to a kit that can minimize the forward and backward movement of the bucket when lifting the bucket vertically. Furthermore, the invention relates to a kit that can provide a self-leveling function to existing loader work apparatuses.

2. Description of the Related Art

Conventional loader work apparatuses have a pair of arms installed on both sides of the vehicle's frame, with a bucket attached to the ends of the arms. A hydraulic cylinder is installed to move the bucket, and the arm ends are supported by a first lift link at the rear of the frame and a second lift link at the front, allowing vertical movement at the front of the vehicle frame. This related technology is disclosed in U.S. Pat. No. 6,205,665 B1.

FIG. 1 shows the movement of the bucket when lifted in a conventional loader work apparatus. The loader work apparatus is mounted on vehicles such as tractors, wheel loaders, skid loaders, or track loaders, and includes a bucket 4 for lifting cargo.

Specifically, the loader work apparatus consists of a lift arm 30 with one end connected to the bucket 4 and the other end connected to the rear of the vehicle body 1, a lift arm hinge part 31 serving as the rotation axis of the lift arm 30, a boom cylinder 20 that transmits force to rotate the lift arm 30, and a cylinder hinge part 21 serving as the rotation axis of the boom cylinder 20.

In conventional loader work apparatuses, the lift arm hinge part 31 and the cylinder hinge part 21 are located at the rear of the vehicle body 1, and the lift arm 30 rotates to rise or fall according to the extension or retraction of the boom cylinder 20.

Typically, vehicles equipped with loader work apparatuses have a cabin located between the front wheels 2 and the rear wheels 3, with the hinge part 21 of the boom cylinder 20 and the lift arm hinge part 31 positioned behind the cabin or over the rear wheels 3.

Due to this structural characteristic, as illustrated in FIG. 1, when lifting or lowering the bucket 4 vertically, the bucket 4 moves forward by distance A or backward by distance B according to the rotation of the lift arm 30.

In other words, as the lift arm 30 rotates around the lift arm hinge part 31, the bucket 4 located at the end of the lift arm 30 moves forward (A) or backward (B) while rising. This causes a problem where the vehicle must reverse by distance A or advance by distance B to lift the bucket 4 vertically.

In loader work apparatuses, the need to advance or reverse the vehicle due to the forward and backward movement of the bucket 4 when lifting it vertically greatly reduces work efficiency.

SUMMARY OF THE INVENTION

The present invention provides a self-leveling kit designed to be coupled to or detached from a loader work apparatus, enhancing its functionality by maintaining a consistent bucket angle during the raising and lowering operations. This kit can be retrofitted to existing loader work apparatuses, making it versatile and efficient.

The loader work apparatus includes a bucket connecting arm connected to a bucket for scooping or holding cargo, a bucket cylinder with a variable length to allow the bucket to rotate about a connection part of the bucket connecting arm, a boom cylinder providing the force required to raise and lower the bucket connecting arm, a boom connected to both the bucket connecting arm and the boom cylinder, a boom support part to which the boom and the boom cylinder are attached, and a boom connecting plate to which the bucket connecting arm, the boom cylinder, and the boom are coupled.

The self-leveling kit comprises a link connecting plate mounted on the boom connecting plate, with one side coupled to the bucket cylinder, a connecting bracket attached to the upper part of the boom support part, and a self-leveling bar connecting the link connecting plate and the connecting bracket.

The invention addresses the issue of bucket movement during vertical lifting by ensuring that the bucket remains at a constant angle, thereby improving operational efficiency. The self-leveling kit can be easily installed or removed by the user, providing flexibility and adaptability for different loader work apparatus configurations.

When the self-leveling bar, cylinder connecting bracket, and connecting bracket are installed, the self-leveling bar interacts with the components to maintain the bucket's position. This feature significantly reduces the need for manual adjustments and enhances the overall performance of the loader work vehicle.

In summary, the invention provides a practical and effective solution for maintaining bucket stability, improving the functionality and efficiency of loader work apparatuses.

DETAILED DESCRIPTION OF THE INVENTION

Figure 2:
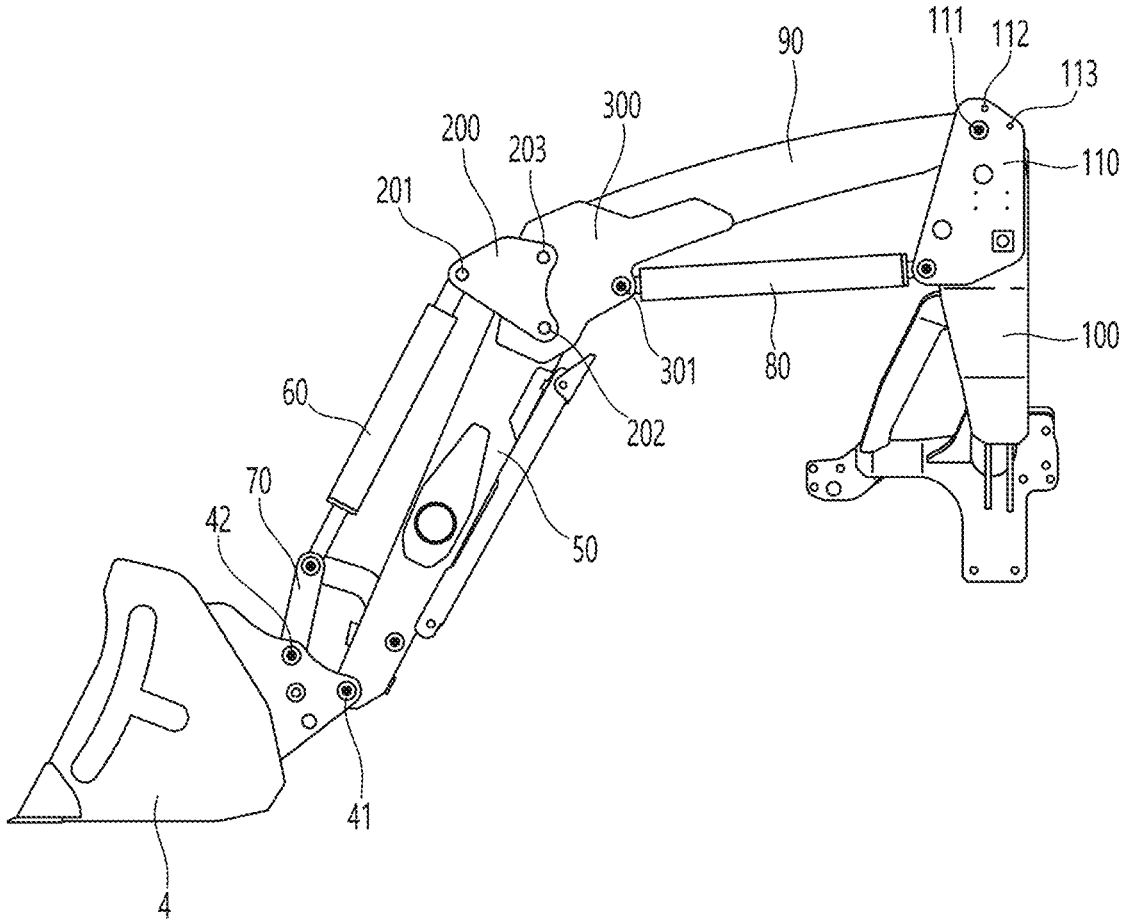
FIG. 2 is a side view of a loader work apparatus without a self-leveling function.

FIG. 2 shows a loader work apparatus without a self-leveling function. Here, self-leveling refers to the ability to maintain a constant bucket posture when the height of the bucket 4 changes. This diagram illustrates the configuration of a work apparatus without self-leveling applied. The loader work apparatus includes a vehicle coupling part 100 mounted on a working vehicle such as a tractor or an industrial vehicle, a bucket 4 for lifting or holding cargo, a bucket connecting arm 50 connected to the bucket, a boom cylinder 80 that provides force to raise and lower the bucket connecting arm 50, a boom 90 that connects the bucket connecting arm 50 and the boom cylinder 80, and a boom support part 110 that connects the boom 90 and the boom cylinder to the vehicle coupling part. The bucket 4 has two or more holes, including a connecting arm coupling hole 41 and a link coupling hole 42. The bucket connecting arm 50 is coupled to the connecting arm coupling hole 41 of the bucket 4 and the boom connecting plate 300, the bucket connecting arm 50 being rotatably coupled to the boom connecting plate 300 via a hinge pin 51. The bucket connecting arm 50 and the boom 90 are connected to each other through the boom connecting plate 300. The boom connecting plate 300 has three coupling holes, and the bucket connecting arm 50 is coupled to one of these coupling holes. The boom connecting plate 300 and its coupling holes will be described in more detail along with the link connecting plate 200 of the self-leveling kit. The bucket link 70 connects the link coupling hole 42 of the bucket 4 and the bucket cylinder 60. The bucket cylinder 60 plays a role in allowing the bucket 4 to rotate around the connecting arm coupling hole 41. The rotation or posture change of the bucket 4 occurs according to the change in length of the bucket cylinder 60. If the length of the bucket cylinder 60 increases, the bucket link 70 is pushed toward the bucket 4, causing the bucket 4 to rotate counterclockwise around the connecting arm coupling hole 41. If the length of the bucket cylinder 60 decreases, the bucket link 70 is pulled, causing the bucket 4 to rotate clockwise.

Figure 1:
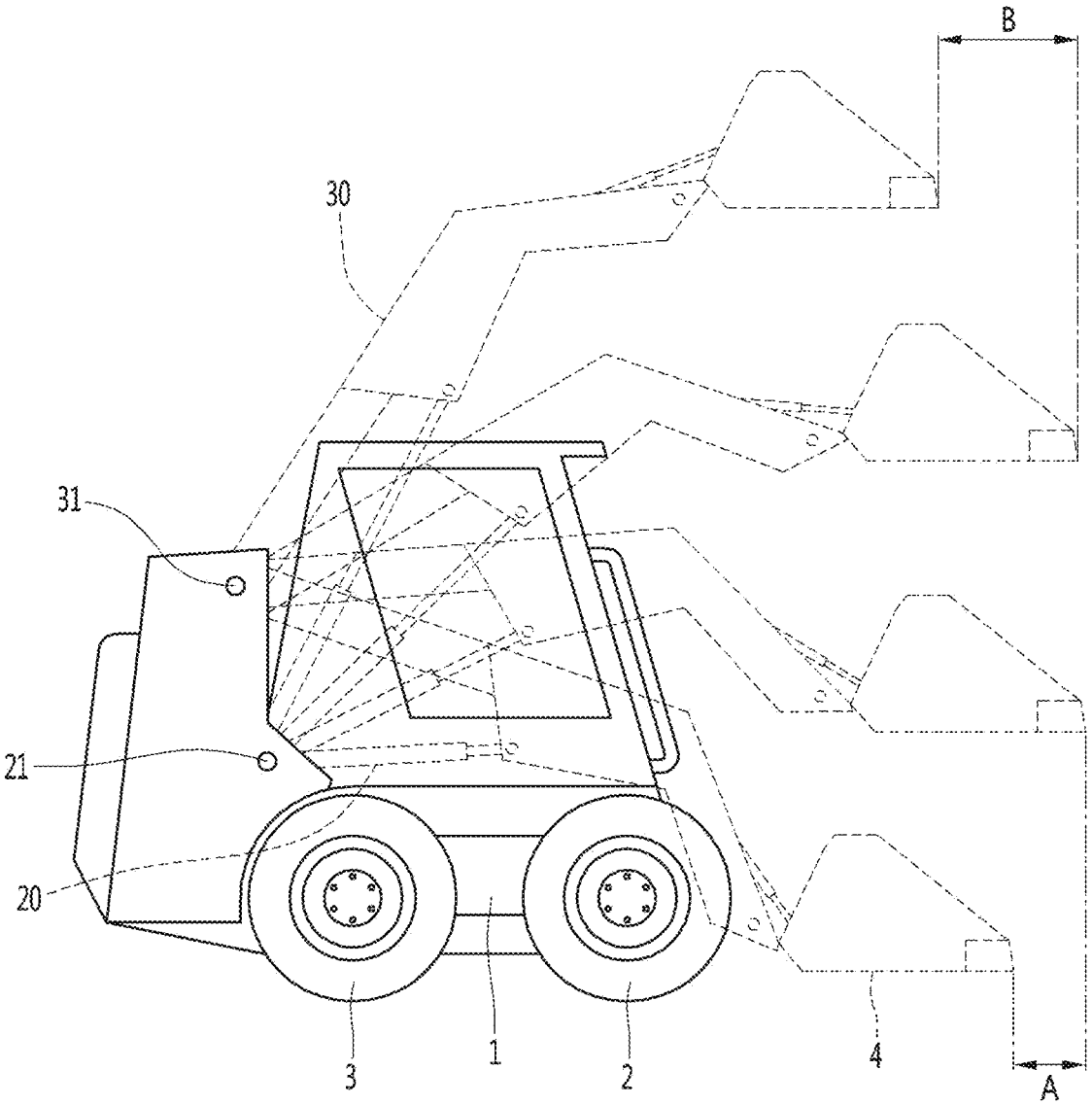
FIG. 1 is a side view showing the movement of the bucket when it is raised in a conventional loader work apparatus.

One end of the bucket cylinder 60 is connected to the bucket link 70, and the other end is connected to the link connecting plate 200. The link connecting plate 200 has three holes, just like the boom connecting plate 300. In the case of a work vehicle without self-leveling applied, as shown in FIG. 1, the first connecting hole 201 of the link connecting plate 200 is connected to the bucket cylinder 60, the second connecting hole 202 is connected to the bucket connecting arm 50 and the boom connecting plate 300, and the third connecting hole 203 is connected to the boom 90 and the boom connecting plate 300.

According to this embodiment, in the case of a work vehicle without the self-leveling kit installed, a link connecting plate 200 with at least three holes is coupled on top of a boom connecting plate 300 that also has three holes. In this configuration, two connecting holes (the second and third connecting holes) of the link connecting plate 200 are positioned to align with two holes on the boom connecting plate 300 and are coupled together using bolts or other fasteners.

Referring to FIG. 2 for explanation, among the components of the self-leveling kit in this embodiment, which include the cylinder connecting bracket 600, self-leveling bar 400, connecting bracket 500, and link connecting plate 200, the three holes of the link connecting plate 200 are connected at different positions when applying self-leveling. In other words, for a work vehicle equipped with a loader lifting device as shown in FIG. 1, the user can separately purchase and install the self-leveling kit onto their work vehicle. In this case, the user must detach the link connecting plate 200 from the boom connecting plate 300 and then reconnect the three holes of the link connecting plate 200 at different positions to apply self-leveling.

Figure 3:
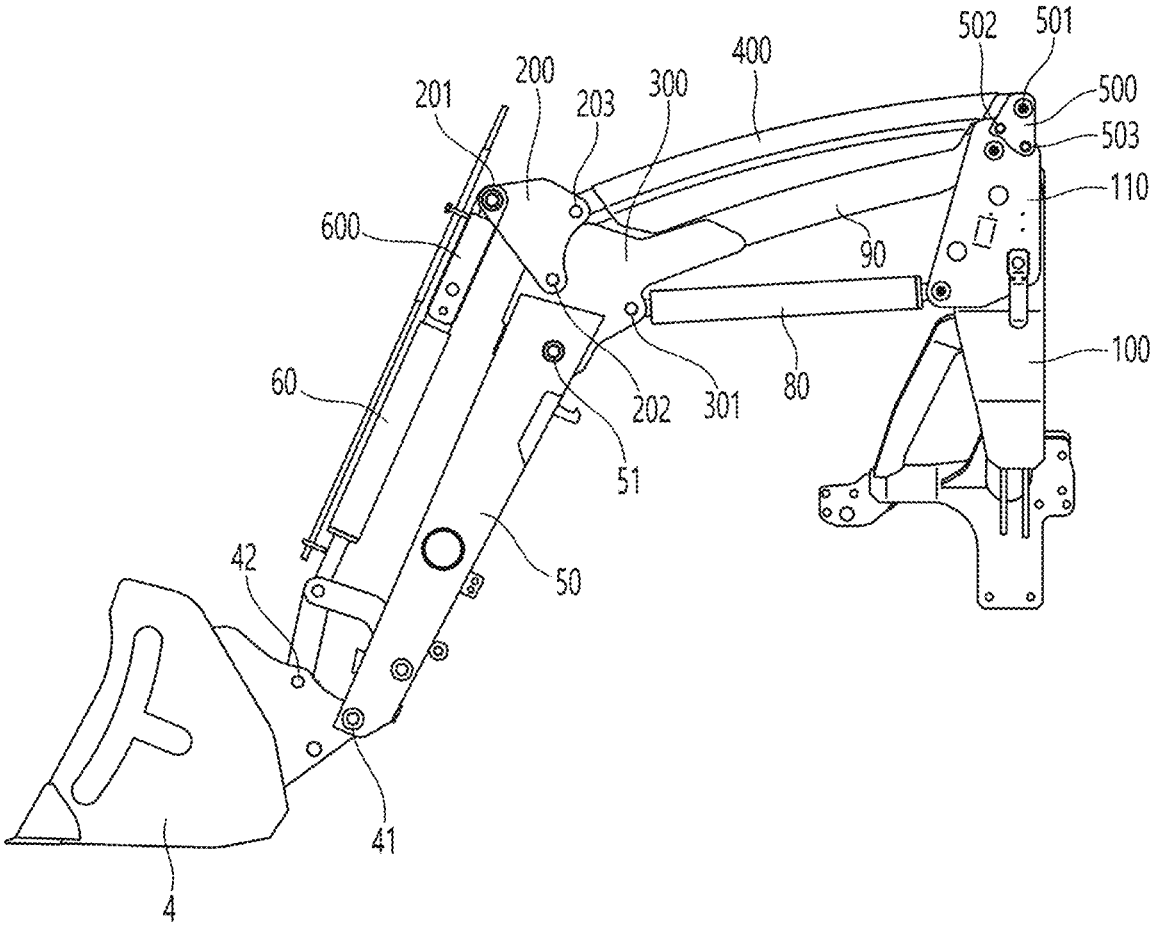
FIGS. 3 and 4 are a side view and an exploded view illustrating the detailed configuration of the self-leveling kit according to the embodiment of the present invention and the kit installed on the loader work apparatus.
Figure 4:
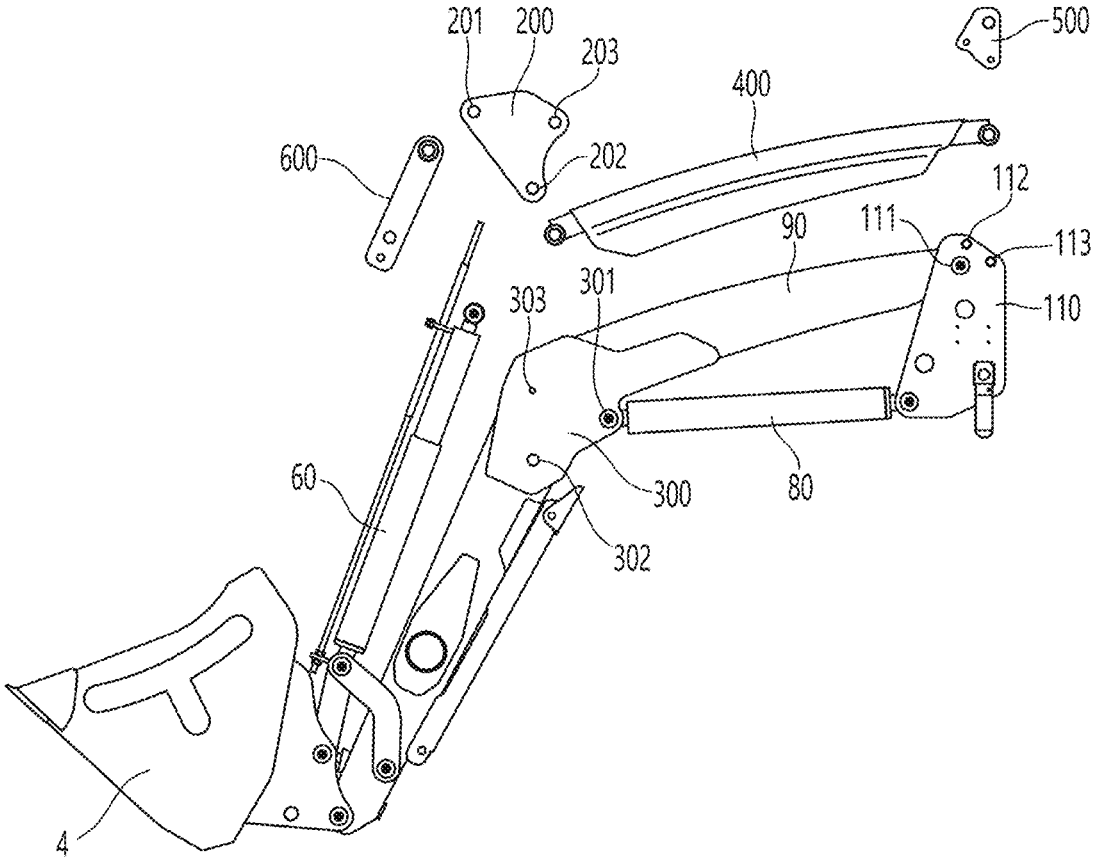

In the case of a vehicle without self-leveling applied (refer to FIG. 1), among the three holes on the boom connecting plate 300, the first boom connecting plate hole 301 is connected to the boom cylinder 80, and the remaining two holes are positioned and connected to match the connecting holes 202 and 203 of the link connecting plate 200. Specifically, the second boom connecting plate hole 302 located below the second connecting hole 202) is connected to the bucket connecting arm 50, and the third boom connecting plate hole 303 (located below the third connecting hole 203) is connected to the boom 90. The boom cylinder 80 plays a role in rotating the bucket connecting arm 50 through changes in its length, which in turn facilitates the raising or lowering of the bucket 4. One end of the boom cylinder 80 is connected to the boom connecting plate 300, while the other end is connected to the boom support part 110. The boom support part 110 is connected to the vehicle coupling part 100 and serves to support the boom cylinder 80 and the boom 90. In particular, there are at least three holes on the upper part of the boom support part 110. Among them, the first support part hole 111 is connected to the boom 90. When the self-leveling kit is not applied, the remaining two support part holes 112 and 113 are not connected to any other components. As a side note, the second support part hole 112 and the third support part hole 113 are the parts that connect to the connecting bracket 500 of the self-leveling kit. The connecting bracket 500 has a first bracket hole 501, a second bracket hole 502, and a third bracket hole 503, wherein the second bracket hole 502 and the third bracket hole 503 are coupled to the second support part hole 112 and the third support part hole 113, respectively. The self-leveling kit according to this embodiment will be described in more detail with reference to FIG. 2 and FIG. 3. FIG. 3 and FIG. 4 show the detailed configuration of the self-leveling kit according to this embodiment and the kit installed on the loader work apparatus. Moreover, FIG. 5 and FIG. 6 demonstrate the self-leveling operation, where the bucket direction is maintained constant during the raising and lowering of the bucket when the self-leveling kit according to this embodiment is installed. In cases where self-leveling is not applied, i.e., in devices without the function to keep the bucket posture unchanged during raising or lowering, the connection between the link connecting plate 200 and the boom connecting plate 300 in the loader work apparatus, of which consists the bucket, cylinders, and other components, is released.

Then, the cylinder connecting bracket 600 is connected to the bucket cylinder 60, and the cylinder connecting bracket 600 is connected to the first connecting hole 201 of the link connecting plate 200. Additionally, the connecting bracket 500 is attached to the upper part of the boom support part 110, and one end of the self-leveling bar 400 is connected to the connecting bracket 500. The other end of the self-leveling bar 400 is connected to the third connecting hole 203 of the link connecting plate 200.

Among the three holes on the link connecting plate 200, the remaining second connecting hole 202 is connected to the boom connecting plate 300. The second connecting hole 202 of the link connecting plate 200 is positioned to align with the third boom connecting plate hole 303 on the boom connecting plate 300 and is joined using bolts or pin assemblies. In other words, the second boom connecting plate hole 302 on the boom connecting plate 300 remains connected to the bucket connecting arm 50, just like before the self-leveling is applied. However, due the to repositioning of the link connecting plate 200, the third boom connecting plate hole 303 is now connected to the second connecting hole 202 of the link connecting plate 200.

Let's take a closer look at the cylinder connecting bracket 600, link connecting plate 200, self-leveling bar 400, and connecting bracket 500, which make up the self-leveling kit of this embodiment. The cylinder connecting bracket 600 extends the length of the bucket cylinder 60, enabling the connection between the bucket 4 and the repositioned link connecting plate 200.

The link connecting plate 200 undergoes changes in its connection positions and targets for the self-leveling operation. Initially, two holes on the link connecting plate 200 are connected to the holes on the boom connecting plate 300. However, for self-leveling, only one hole on the link connecting plate 200 is connected to a hole on the boom connecting plate 300. Specifically, the first connecting hole 201 of the link connecting plate 200 is connected to the cylinder connecting bracket 600, and the second connecting hole 202 is repositioned and connected to the third boom connecting plate hole 303 on the boom connecting plate 300. The third connecting hole 203 moves to a position outside the boom connecting plate 300 and connects to the self-leveling bar 400.

The self-leveling bar 400 eliminates the need for users to perform additional work by automatically adjusting the length of the bucket cylinder 60 to maintain the posture of the bucket 4 as it rises. When the length of the boom cylinder 80 increases to lift the bucket 4, the boom cylinder 80, boom 90, and self-leveling bar 400 rotate clockwise by a certain angle around the boom support part 110. At this point, the self-leveling bar 400 applies a pushing force to the third connecting hole 203 of the link connecting plate 200, and the link connecting plate 200 rotates counterclockwise by a certain angle around the second connecting hole 202.

Figure 5:
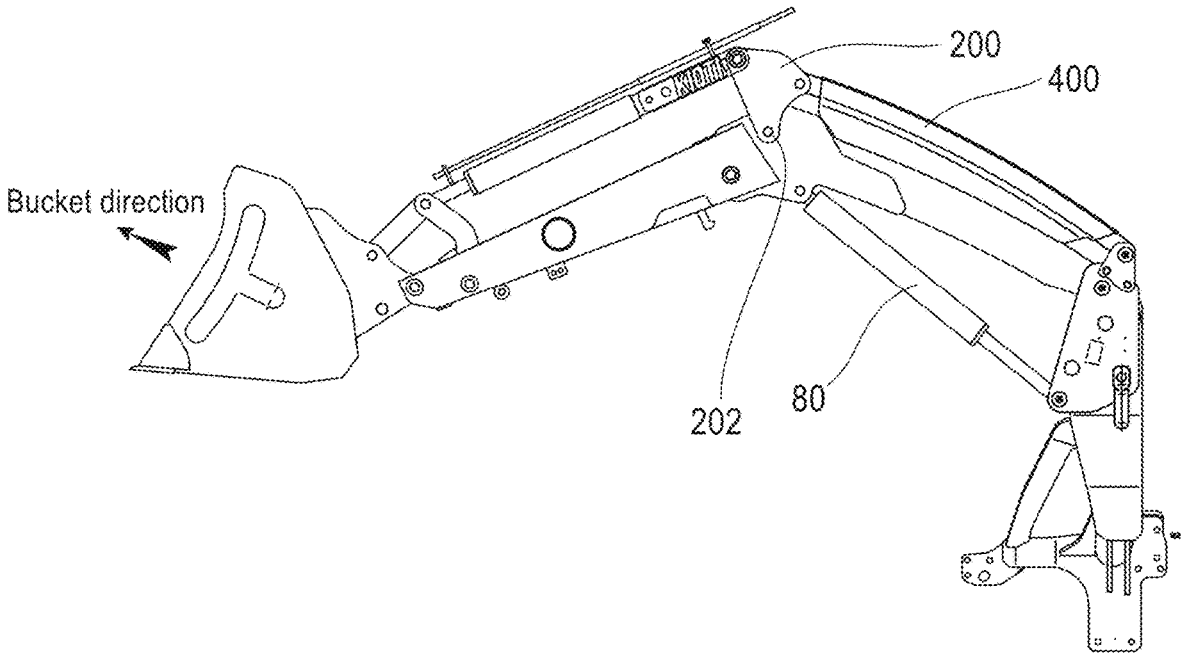
FIGS. 5 and 6 are side views representing the self-leveling operation, where the bucket direction is kept constant during the raising and lowering of the bucket when the self-leveling kit according to the embodiment of the present invention is installed.
Figure 6:
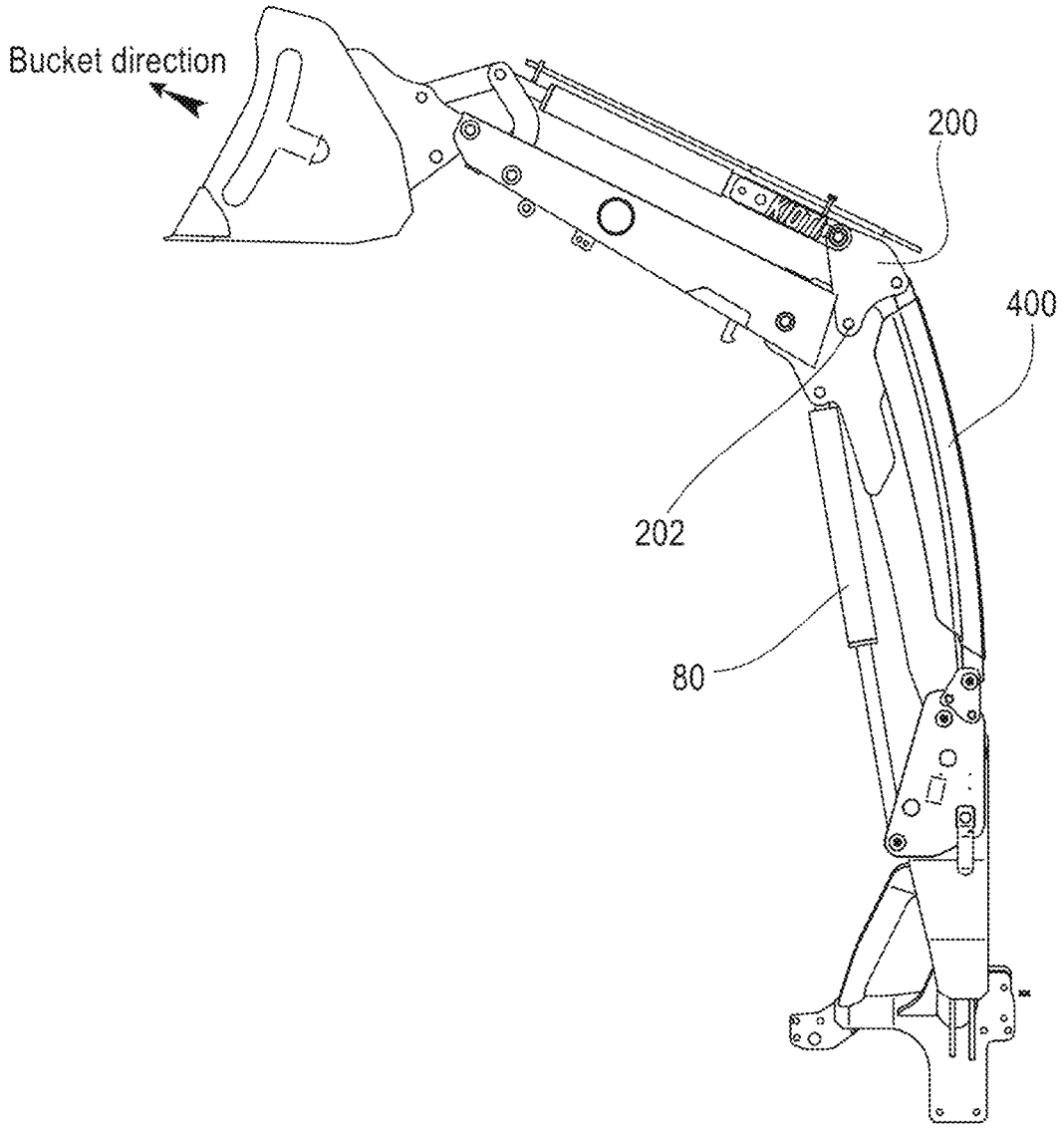

Comparing the gradual ascent of the bucket 4 with reference to FIGS. 2, 5, and 6, it can be seen that as the length of the boom cylinder 80 gradually increases due to its operation, the boom cylinder 80 rotates clockwise by a certain angle on the diagram around the hole connected to the boom support part 110. The self-leveling bar 400 is connected to the first bracket hole 501 of the connecting bracket 500 and the third connecting hole 203 of the link connecting plate 200. When the bucket rises, the self-leveling bar 400 pushes the third connecting hole 203 of the link connecting plate 200 in the direction of the bucket cylinder, causing the link connecting plate 200 to rotate counterclockwise by a certain angle around the second connecting hole 202. This allows the bucket direction to be maintained constant without changing the length of the bucket cylinder 60.

According to the embodiment of the present invention described above, even for work vehicles with loaders that do not have a self-leveling function, users can later install the self-leveling kit constant to maintain a bucket angle (direction) during the raising and lowering of the bucket. This can improve the efficiency of work performed using loaders.

The invention claimed is:

1. A self-leveling kit configured to be coupled to or detached from a loader work apparatus, the loader work apparatus comprising:

a bucket connecting arm connected to a bucket for scooping or holding cargo;

a bucket cylinder having a variable length to allow the bucket to rotate about a connection part of the bucket connecting arm;

a boom cylinder providing force for raising and lowering the bucket connecting arm;

a boom connected to the bucket connecting arm and the boom cylinder;

a boom support part to which the boom and the boom cylinder are coupled; and a boom connecting plate to which the bucket connecting arm, the boom cylinder, and the boom are coupled, wherein the self-leveling kit comprises:

a link connecting plate mounted on the boom connecting plate, the link connecting plate having one side coupled to the bucket cylinder;

a connecting bracket coupled to an upper part of the boom support part; and a self-leveling bar coupled to the link connecting plate and the connecting bracket.

2. The self-leveling kit according to claim 1, wherein the bucket cylinder is connected to the link connecting plate via a cylinder connecting bracket.

3. A loader work vehicle capable of raising and lowering a bucket, the loader work vehicle comprising:

a bucket connecting arm connected to the bucket;

a bucket cylinder having a variable length to allow the bucket to rotate about a connection part of the bucket connecting arm;

a boom cylinder providing force for raising and lowering the bucket connecting arm;

a boom connected to the bucket connecting arm and the boom cylinder;

a boom support part to which the boom and the boom cylinder are connected;

a boom connecting plate having at least three connecting holes, the boom connecting plate being connected to the bucket connecting arm, the boom cylinder, and the boom;

a link connecting plate having first to third connecting holes, wherein a coupling position of the link connecting plate is changeable among the holes of the boom connecting plate by a user;

a vehicle coupling part connected to the loader work vehicle;

a connecting bracket detachably connected to an upper part of the vehicle coupling part by the user, the connecting bracket having multiple holes;

a cylinder connecting bracket detachably connected between the bucket cylinder and the link connecting plate;

a self-leveling bar detachably connected between the link connecting plate and the connecting bracket; and a self-leveling kit comprising the link connecting plate, the connecting bracket, the cylinder connecting bracket, and the self-leveling bar.

4. The loader work vehicle according to claim 3, wherein a first boom connecting plate hole of the boom connecting plate is connected to the boom cylinder, wherein, when the self-leveling bar, the cylinder connecting bracket, and the connecting bracket are not installed, the first connecting hole of the link connecting plate is connected to the bucket cylinder, the second connecting hole of the link connecting plate is connected to a second boom connecting plate hole of the boom connecting plate, and the third connecting hole of the link connecting plate is connected to a third boom connecting plate hole of the boom connecting plate and the boom connecting plate, and wherein, when the self-leveling bar, cylinder connecting bracket, and the connecting bracket are installed, the first connecting hole is connected to the cylinder connecting bracket, the second connecting hole is connected to the third boom connecting plate hole of the boom connecting plate, and the third connecting hole is connected to the self-leveling bar at a position outside the boom connecting plate.

5. The loader work vehicle according to claim 4, wherein, when the self-leveling bar, the cylinder connecting bracket, and the connecting bracket are installed, the self-leveling bar is connected to a first bracket hole of the connecting bracket and the third connecting hole of the link connecting plate, such that when the bucket rises due to an operation of the boom cylinder, the self-leveling bar pushes the link connecting plate in a direction of the bucket cylinder while rotating clockwise about the first bracket hole, and the link connecting plate is configured to rotate counterclockwise by a predetermined angle about the second connecting hole.

* * * * *